US006142690A

United States Patent [19]

Yoshimura et al.

[11] Patent Number: 6,142,690

[45] Date of Patent: Nov. 7, 2000

[54] COLOR IMAGE FORMING APPARATUS WITH DRIVE POWER TRANSMISSION MECHANISM

[75] Inventors: Hiroshi Yoshimura, Tokyo; Nobuo Iwata, Sagamihara, both of Japan

[73] Assignee: Ricoh Company, Ltd., Tokyo, Japan

[21] Appl. No.: 08/970,143

[22] Filed: Nov. 12, 1997

[30] Foreign Application Priority Data

| | | | |
|---|---|---|---|
| Nov. 11, 1996 | [JP] | Japan | 8-314185 |
| Mar. 8, 1997 | [JP] | Japan | 9-070795 |
| May 6, 1997 | [JP] | Japan | 9-132822 |

[51] Int. Cl.[7] ..... B41J 13/036

[52] U.S. Cl. ..... 400/636.2; 399/299; 399/300

[58] Field of Search ..... 400/120.02, 636.2; 399/299, 300

[56] References Cited

U.S. PATENT DOCUMENTS

| | | | |
|---|---|---|---|
| 4,796,050 | 1/1989 | Furuta et al. | 355/4 |
| 4,803,515 | 2/1989 | Hoshino et al. | 355/4 |
| 5,386,286 | 1/1995 | Kinouchi et al. | 355/326 |
| 5,492,421 | 2/1996 | Fushimi et al. | 400/120.02 |

FOREIGN PATENT DOCUMENTS

| | | |
|---|---|---|
| 6167858 | 6/1994 | Japan . |
| 7209947 | 8/1995 | Japan . |

*Primary Examiner*—John S. Hilten
*Assistant Examiner*—Amanda B. Sandusky
*Attorney, Agent, or Firm*—Cooper & Dunham LLP

[57] ABSTRACT

An image forming apparatus having a plurality of image bearing members disposed parallel along a conveying direction of recording sheet and a drive power transmission mechanism that translates movement of a drive source to synchronized and uniform movement of the image bearing members is provided. One embodiment of the drive power transmission mechanism includes a plurality of drive power transmission members and a plurality of intermediate transmission members alternately arranged in groups that are offset relative to each other. The drive power and intermediate transmission members in each group are arranged within a predefined angular orientation to ensure synchronized, uniform movement of the image bearing members and uniform distribution of the toner for each color of the color image being recorded.

38 Claims, 17 Drawing Sheets

COLOR IMAGE FORMING APPARATUS WITH DRIVE POWER TRANSMISSION MECHANISM

BACKGROUND

1. Field of the Invention

The present application relates to image forming apparatus such as copying machines, printers and facsimile machines. More particularly, the present application relates to image forming apparatus in which the rotation of a plurality of image bearing members is more evenly matched to maintain even toner distribution and improve image quality.

2. Description of the Related Art

In so-called tandem type image forming apparatus, four image bearing members on which latent images of different colors are formed, are disposed in parallel along a conveying direction of a recording sheet. With such known image forming apparatus, color images are formed on recording sheets as they pass each image bearing member in the conveying direction.

FIGS. 15 and 16 are side elevational and top plan views showing an exemplary construction of a drive power transmission mechanism for the image bearing members in the above-mentioned image forming apparatus. Gears 3B, 3M, 3Y and 3C are mounted at an end portion of each rotational shaft of photoconductive elements 1B, 1M, 1Y and 1C used as the image bearing members. Gear 3C of the photoconductive element 1C is engaged with a drive gear 10 of a motor 9 provided as a drive power source. Intermediate gears 28 are disposed between the gears of each photoconductive element, as seen in FIG. 15. As the motor 9 rotates, a drive power is translated to each photoconductive element via the gears of the photoconductive elements and the intermediate gears, so that the photoconductive elements 1B, IM, 1Y and 1C rotate at the same time.

Additional configurations of the drive power transmission mechanisms for image forming apparatus provided with a plurality of image bearing members are known. For example, in Japanese Laid-Open Patent Application No. 167858/1994, the gears of each rotating image bearing members are inter-connected via intermediate gears which transmit drive power with a high reduction speed ratio.

In Japanese Laid-Open Patent Application No. 7-209947, the drive power transmission mechanism is provided with the drive gear of the drive power source which is engaged with a drive gear of the photoconductive element disposed adjacent to the drive power source, and a driven gear in which rotation transmitted from the drive gear is further transmitted to the driven gear of the other photoconductive elements via an intermediate gear.

Further, FIG. 17 illustrates a drive power transmission mechanism in which a toothed timing belt 40 is used to translate rotational movement of the motor to the image bearing members. This is known drive power transmission mechanism is composed of pulleys 41C, 41Y, 41M and 41B mounted on an end of the rotating shafts of the photoconductive elements 1C, 1Y, 1M and 1B, an idler 42, a timing belt 40, an idler 43, a tension pulley 44, a drive pulley 45 and a drive motor 9.

One drawback to the drive power transmission mechanism shown in FIGS. 15 and 16, is that rotation of the photoconductive elements may become uneven which may result in a line of the location of the gears defining a drive power transmission path for the image bearing members that is too long. As a result, an unevenness of rotation between photoconductive element 1C and 1B may occur, which may result in an unevenness of the image density Further, the drive power transmission mechanism disclosed in the aforementioned Japanese Laid-Open Patent Application No. 6-167858 discusses that accumulation of the unevenness of rotation can be limited by using intermediate gears. However, in this construction, the line defining the drive power transmission path is too long so that the transmissibility of the drive power from gear to gear may deteriorate. Furthermore, machines with large drive power transmission paths tend to generate noise caused by the meshing of the gears.

In addition, when a timing belt is used, as shown in FIG. 17, even though the engagement between the timing belt 40 and each driven pulley reaches a smooth state, an unevenness of rotation (or vibration) of the photoconductive elements cannot be completely avoided because irregularities in the engagement between the belt and pulleys often occurs. When the photocoductive elements vibrate, the density of the image becomes uneven so that banding appears in the image, and possibly the quality of the image deteriorates.

SUMMARY

The present application provides a color image forming apparatus that includes multiple image bearing members and a drive power transmission mechanism to synchronize movement of the image bearing members to maintain uniform toner distribution for each color and improve color image quality.

In one embodiment the image forming apparatus includes image bearing means disposed along a conveying direction of recording sheet, and drive power transmission means intermediate of said image bearing means and drive source means. The drive power transmission means is configured to translate movement of the drive source means to synchronized and uniform movement of the image bearing means so that toner for each of a plurality of colors is uniformly distributed for high quality color images. One way to achieve the desired synchronized and uniform movement of the image bearing means is to divide the drive power transmission means into groups arranged in an alternating relationship and offset relative to each other. Preferably, the image bearing means, in this embodiment, includes a plurality of image bearing members and the drive power transmission means includes a plurality of drive gears and a plurality of intermediate gears. A predefined number of the plurality of drive gears and at least one of the intermediate gears are included in each of the groups, and the arrangement of the gears in each group is defined by a predefined angle. In one exemplary arrangement, the predefined angle is approximated as an integral multiple of the quotient of 360° and a number of teeth on one drive gear in the group. In another exemplary arrangement, the predefined angle is defined by two intersecting lines. A first line connects a center of one of the drive gears in the group and a center of an intermediate gear, and a second line connects a center of another drive gear in the group and the center of the intermediate gear.

The drive source means of the present application may include at least one source gear that engages the intermediate gears to translate rotational movement of the drive source means to rotational movement of the intermediate gear. Preferably, the arrangement of the source gear relative to the intermediate gear is defined by a predefined angle. In one exemplary arrangement, the predefined angle is approximated as an integral multiple of the quotient of 360° and a number of teeth on the source gear. In another exemplary arrangement, the predefined angle is defined by two intersecting lines. A first line connects a center of one intermediate gear and a center of the source gear, and a second line connects a center of another intermediate gear and the center of the source gear.

Although gears are described for the drive power transmission means, the present application also contemplates using other known techniques, such as pulleys and belts, in the arrangement of the present application to translate movement of a drive source to movement of the image bearing means.

The present application also provides a method of fabricating color image forming apparatus. One embodiment of the method according to the present application includes disposing image bearing means along a conveying direction of recording sheet, and positioning drive power transmission means intermediate of said image bearing means and drive source means. The drive power transmission means according to this embodiment is positioned to translate movement of the drive source means to movement of the image bearing means. To provide synchronous and uniform movement of the image bearing means, the drive power transmission means is divided into alternating arranged groups that are offset relative to each other and the drive source means. Preferably, the image bearing means includes a plurality of image bearing members, the source means includes a source gear, and the drive power transmission means is positioned such that a plurality of drive gears and a plurality of intermediate gears included in the drive power transmission means form offsetting groups, such that a predefined number of the plurality of drive gears and at least one intermediate gear are included in each group. Further, the drive gears in each group and one intermediate gear are arranged relative to a first predefined angle, and the intermediate gears and the source gear are arranged relative to a second predefined angle.

BRIEF DESCRIPTION OF THE DRAWINGS

A more complete appreciation of the application and the attendant advantages thereof can be made by referring to the following detailed description when considered in connection with the accompanying drawings, wherein.

DETAILED DESCRIPTION

The present application provides a color image forming apparatus that includes multiple image bearing members and a drive power transmission mechanism to synchronize movement of the image bearing members to maintain uniform toner distribution for each color to improve color image quality.

Figure 1:
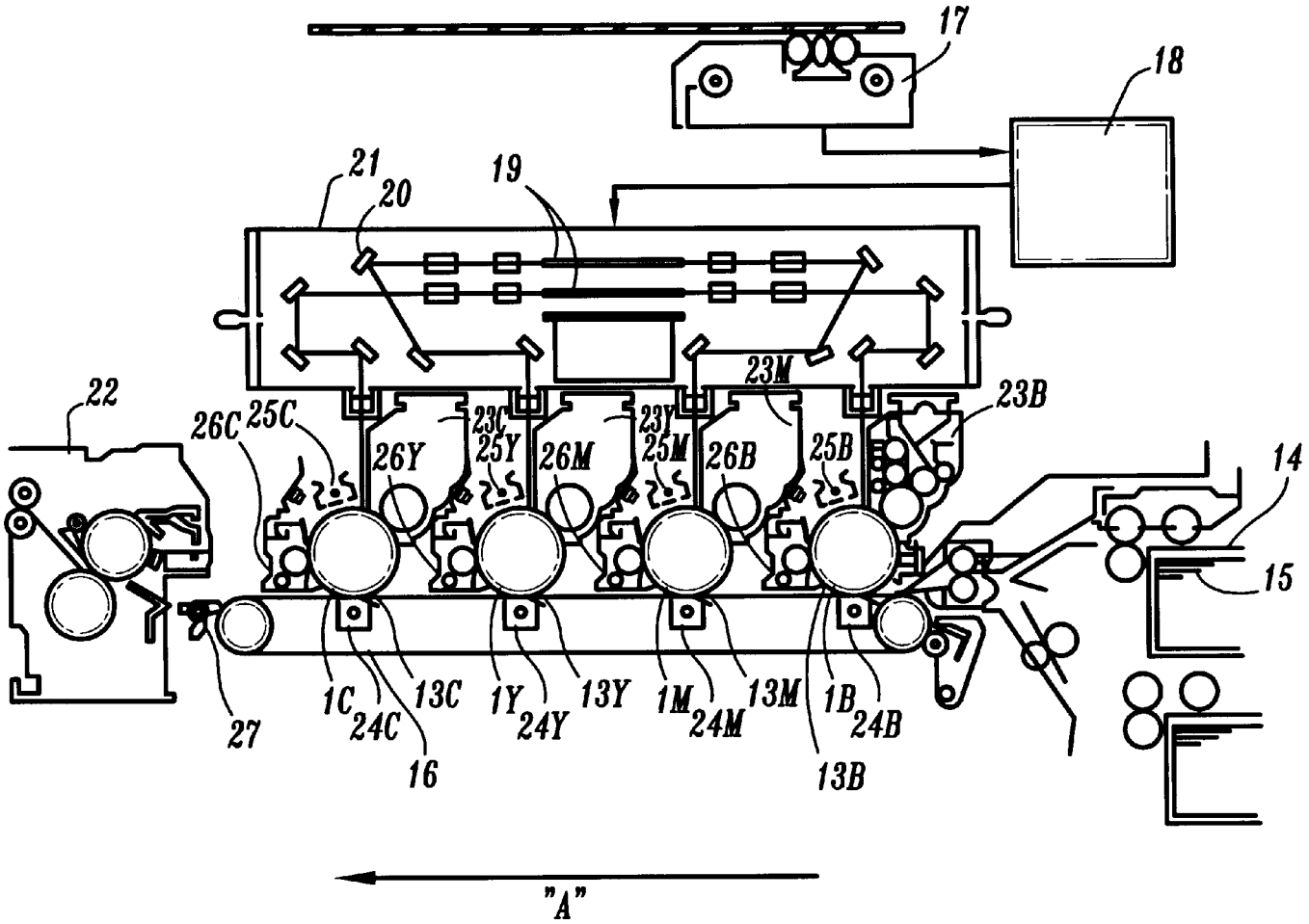
FIG. 1 is a schematic representation of a color image forming apparatus according to the present application.

FIG. 1 is a schematic representation of an exemplary construction of a color image forming apparatus according to the present application. The apparatus in this exemplary configuration includes four image forming sections 13, where the labels 13B, 13M, 13Y and 13C represent the image forming sections for the colors black, magenta, yellow and cyan, respectively. The image forming sections are sequentially disposed along a conveying direction "A" of a recording sheet 15, as a recording member, in the image forming apparatus. In this exemplary configuration, each image forming section 13 includes an image bearing member 1, such as drum-shaped photoconductive elements. Each image forming section 13 also includes a developing unit 23, a charging unit 25, and a cleaning unit 26. Thus, for the color black, the image forming section is identified as 13B, the image bearing member is 1B, the developing unit is 23B, the charging unit is 25B and the cleaning unit is 26B. The units for the colors magenta (M), yellow (Y) and cyan (C) are identified in a similar fashion.

A transfer belt 16 is provided to convey a recording sheet 15 from a recording sheet feeding section 14 through the image forming sections 13 to a fixing unit 22. A laser scanner 21 exposes a surface of the image bearing members of the image forming sections 13 by reflecting a laser beam from a source (not shown) using a polygon scanner 19 and reflection mirrors 20 or the like. More particularly, main scanning in the shaft direction of each image bearing member is achieved by rotating the polygon scanner 19, and sub-scanning of the outer surface of each image bearing member 1 is achieved by rotating shafts 2 of the image bearing members 1.

To form a latent image for each color, the surface of each image bearing member (or photoconductive element) is exposed by the scanner 21 in a pattern corresponding to an image to be formed. Then, each photoconductive element 1 is uniformly charged by the charging unit 25. The latent image is developed by the developing unit 23 to form a toner image for each color. Each toner image is then transferred onto the recording sheet 15, and toner remaining on each photoconductive element 1 is removed by the cleaning unit 26. After the toner images are transferred onto the recording medium, the medium is conveyed along the transfer belt 16 and is separated from the transfer belt 16 by a separation pick 27 located at an end portion of the transfer belt 16 and further conveyed to a fixing unit 22 where the resultant image is fixed to the medium by for example heating, and subsequently to a sheet discharging unit (not shown).

To ensure proper alignment of each of the colors forming the resultant image, an exposure start timing is arranged so that as the recording sheet 15 is conveyed through the image forming sections 13, the latent image for each color is formed on each photoconductive element and the toner images are transferred to the recording sheet at the proper position. To provide high quality color images, it is desired that the movement (e.g. rotation) of the photoconductive elements 1 be synchronized and uniform to ensure that the toner for each color is evenly distributed at the proper location on the recording medium.

Figure 2:
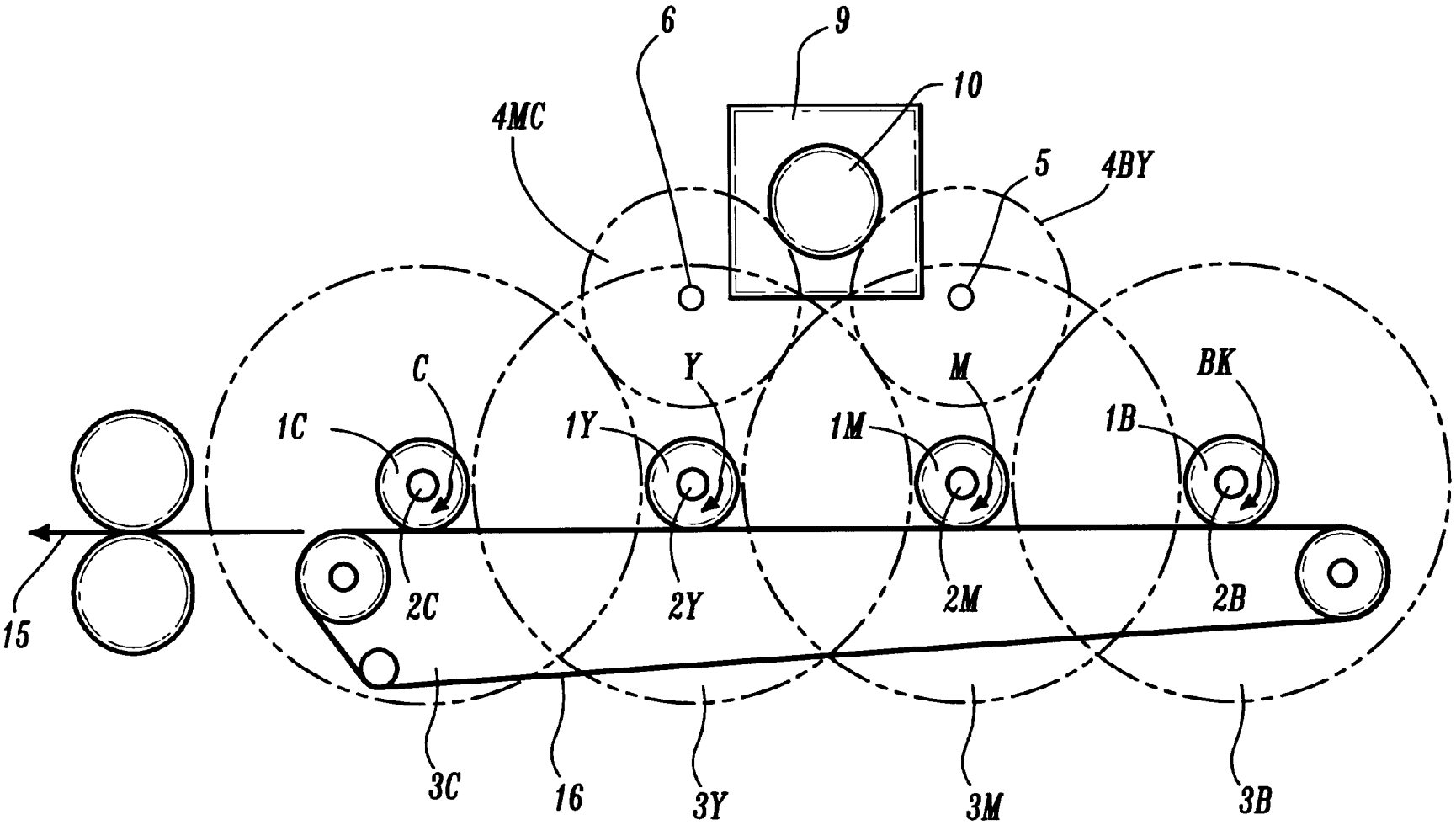
FIG. 2 is side elevational view of a schematic representation of a drive power transmission mechanism for a color image forming apparatus relating to an embodiment of the present application.
Figure 3:
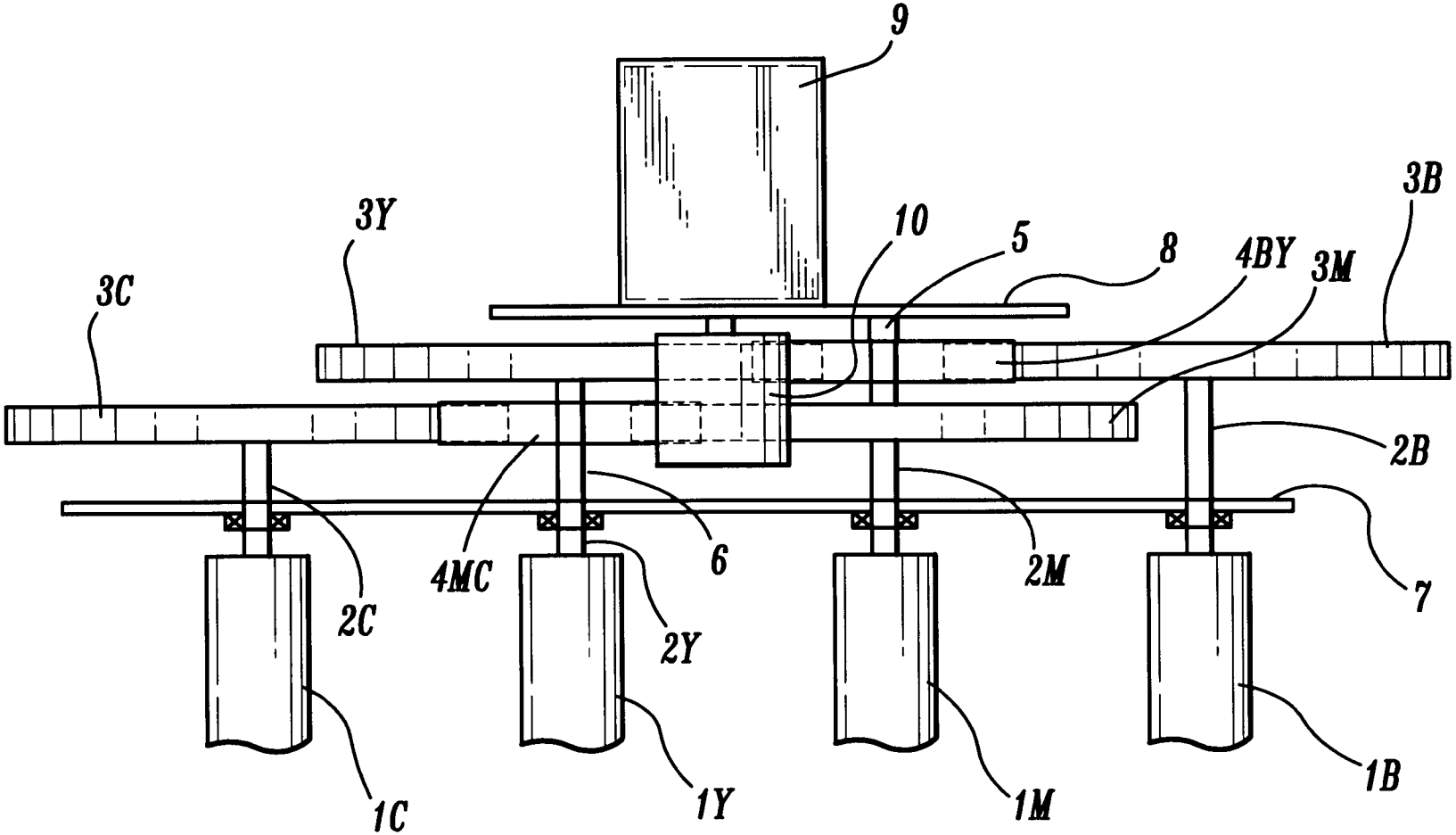
FIG. 3 is a top plan view of the drive power transmission mechanism of FIG. 2.
Figure 4:
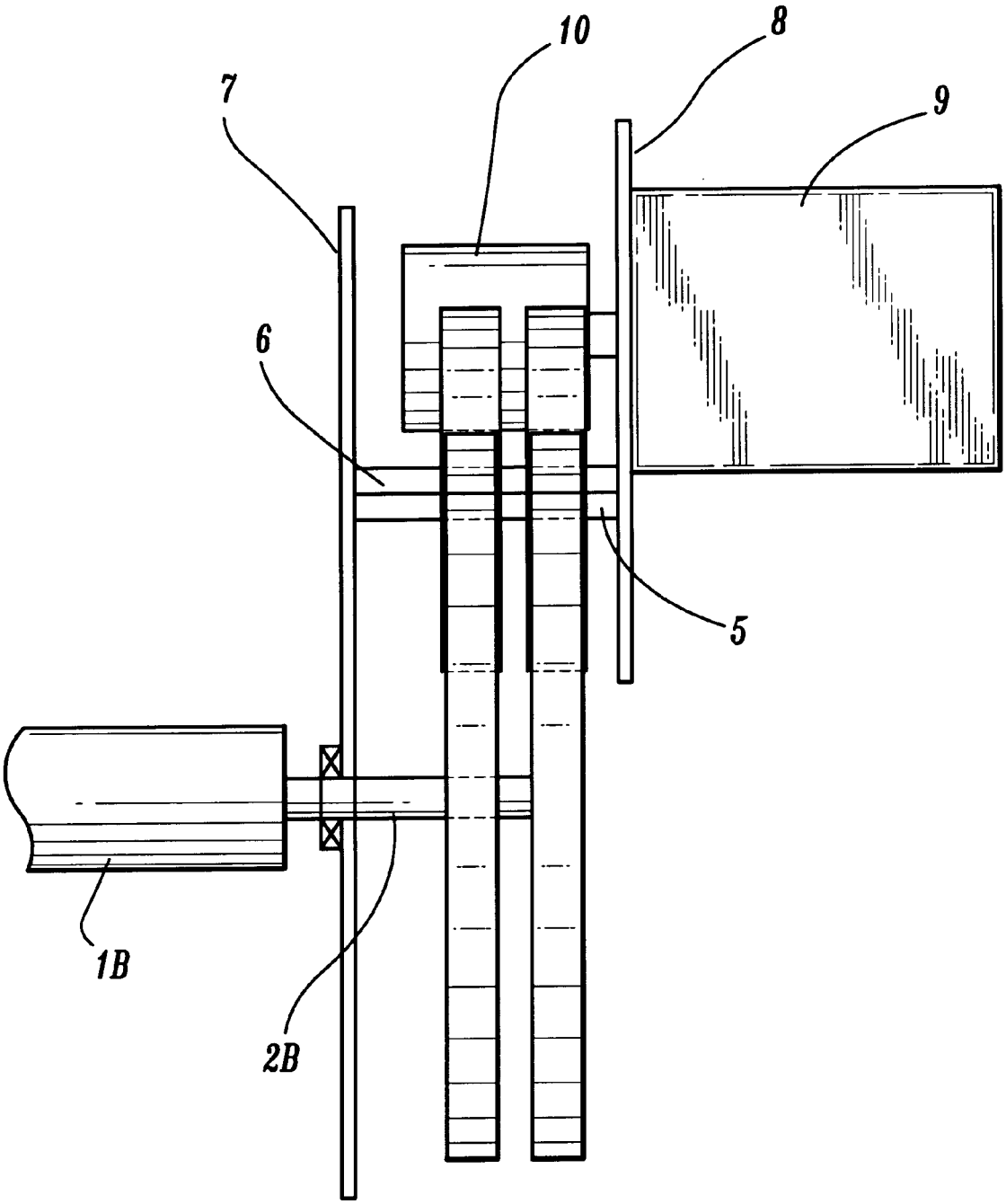
FIG. 4 is a front elevational view of the drive power transmission mechanism of FIG. 2.

Referring now to FIGS. 2–4, different views of one embodiment of a drive power transmission mechanism to provide such synchronized and uniform movement of the image bearing members are shown. In this embodiment, the photoconductive elements 1 are positioned in the apparatus so that the distance between the shafts 2 of each adjacent photoconductive element is equal. Further, the shafts 2 of the photoconductive elements 1 pass through side plate 7 secured to the main body of the apparatus which is used to support each photoconductive element 1, as shown in FIG. 3. Drive power transmission members 3, such as drive gears, are mounted on the shafts 2 of each photoconductive element 1 and form a portion of the drive power transmission mechanism.

In this embodiment, two of the drive gears, e.g., the odd numbered gears 3B and 3Y in the order of the conveying direction of the recording sheet, form a first drive power transmission member group. The other two drive gears, e.g., the even numbered gears 3M and 3C in the order of the conveying direction of the recording sheet, form a second drive power transmission member group. An intermediate drive power transmission member, such as intermediate gear 4BY, engages the odd numbered drive gears (e.g., drive gears 3B and 3Y), and an intermediate drive power transmission member, such a intermediate gear 4MC, engages the even numbered drive gears (e.g., gears 3M and 3C). The intermediate drive power transmission members form another portion of the drive power transmission mechanism of the present application. Intermediate gear 4BY is rotatably mounted to a shaft 5 which is supported on drive unit side plate 8, and intermediate gear 4MC is rotatably mounted to a shaft 6 of the main body side plate 7.

A motor 9, used a drive power source, is fixed to the drive unit side plate 8, and a source gear 10, used as a source transmission member, is connected to a rotational shaft of the motor 9. The source gear 10 engages the intermediate gears 4BY and 4MC.

With the drive power transmission mechanism, the intermediate gears 4BY and 4MC engaged with the source gear 10 rotate when the motor 9 is driven. When the intermediate gear 4BY rotates, the drive gears 3B and 3Y engaged therewith rotate at the same time, and when the intermediate gear 4MC rotates, the drive gears 3M and 3C engaged therewith rotate at the same time so that rotation of the photoconductive elements 1B, 1M, 1Y and 1C is synchronized.

In this embodiment, the first and second groups of drive gears are staggered in relation to the direction of the shafts 2 of the photoconductive elements 1 (or relative to the drive source) so that the drive gears 3 can be formed with diameters that are greater than the distance between the shafts of the photoconductive elements. As a result, the spacing between the image bearing members is less than the spacing of conventional apparatus, so that the synchronized rotation of the photoconductive element is uniform, providing evenly distributed toner for each color and high quality color images.

To illustrate an exemplary configuration of the drive power transmission mechanism, the photoconductive elements 1 are made with the same diameter of 30 mm. The distance between the shafts 2 of adjacent photoconductive elements 1 is set to 94.2 mm which is a function of the circumferential length of one photoconductive element (e.g., element 1B) expressed as 30 mm×π=94.2 mm. The outer diameter of each drive gear is 156 mm and the number of teeth on each gear is 312 so that the module of each drive gear 3 is 156/312 or 0.5 mm. As noted, the outer diameter of each drive gear 3 is about 156 mm which is larger than the distance between the shafts 94.2 mm. In this structure, an unevenness of the distribution of toner on the printed image that may be the result of an unevenness of rotation between the photoconductive elements 1 caused by the interaction of the drive gears can occur at fixed intervals defined by the following expression:

interval=diameter of photoconductive element×π/number of teeth of gear Thus, in the above illustration the interval of unevenness is a distance of 30×π/312=0.30 mm, and the spatial frequency (S.F.) is 1/0.3 or 3.33 Hz/mm.

In general, unevenness of the toner distribution is visible if the interval of unevenness of the toner distribution is 0.52 mm or greater. Thus, in the illustration described above with reference to FIG. 2, the interval of unevenness of toner distribution is 0.30 mm so that the unevenness of toner distribution is not visible and high quality color images can be obtained.

Figure 5:
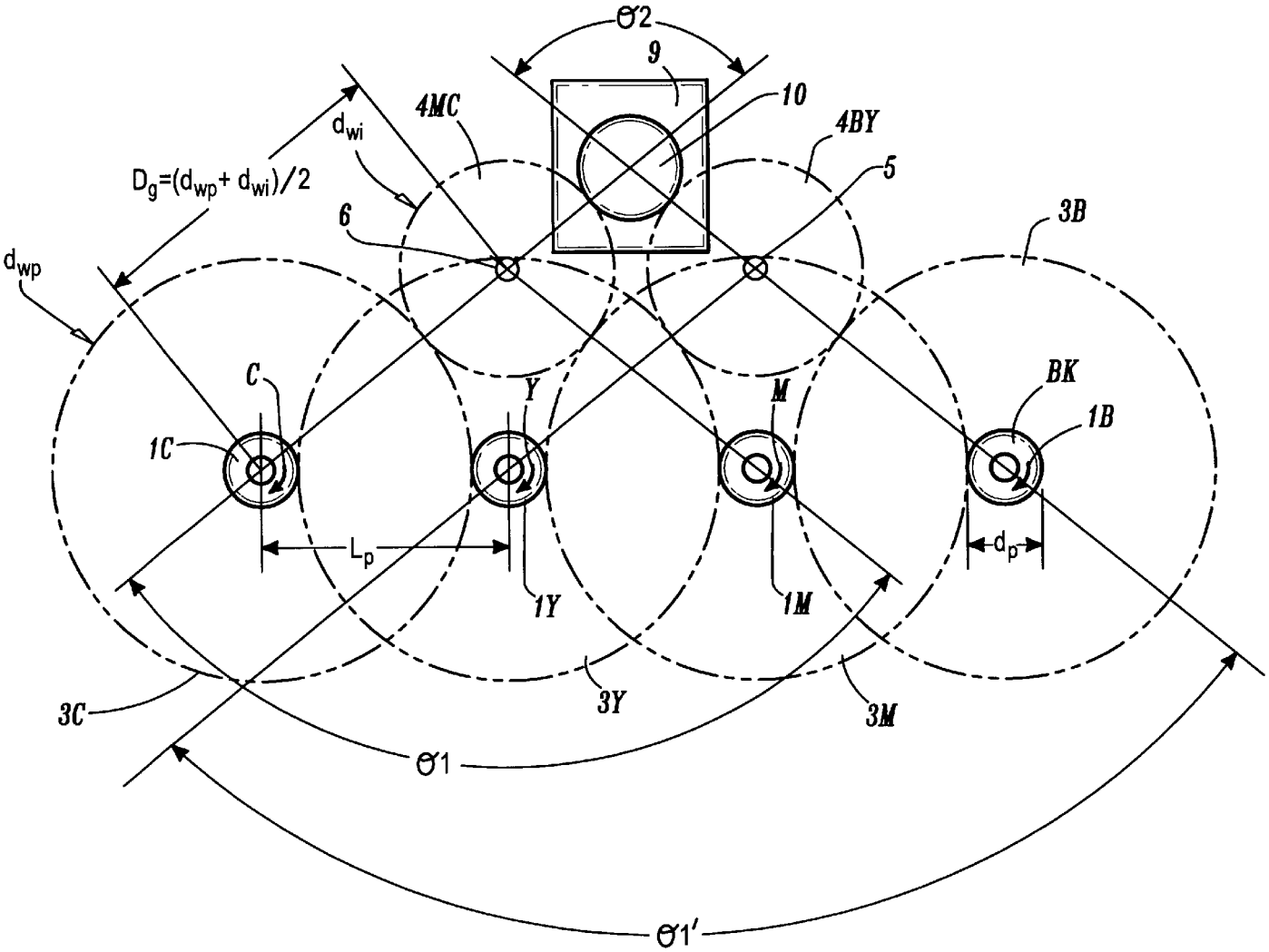
FIG. 5 is a schematic representation of the drive power transmission mechanism illustrating a gearing configuration for reducing rotational unevenness of the photoconductive elements of the color image forming apparatus of the present application.

Referring to FIGS. 2 and 5, a relationship between the drive gears 3, the intermediate gears 4 and the source gear 10 will be discussed. For the embodiments described below, the relationship is based on angular orientations of these gears which are defined below as θ1 and θ2. Assuming that the diameter of each photoconductive element 1 is dp, the distance between adjacent shafts 2 of the photoconductive elements is Lp, the number of teeth of each drive gear is Zp, the number of teeth on each intermediate gear 4 is Zi, and the diameter of the pitch circle for each drive gear 3 and each intermediate gear 4 are dwp and dwi respectively. An angle of intersection θ1 between two straight lines, one passing through the center of the intermediate gear 4MC and the center of the drive gear 3M, and the other passing through the center of the intermediate gear 4MC and the center of the drive gear 3C is determined using the following equation:

$$\theta 1=2\times[90^\circ-\cos^{-1}[Lp/\{(dwp+dwi)/2\}]]$$

Continuing to refer to FIG. 5, the angle of intersection θ1' between the line passing through the center of the intermediate gear 4BY and the center of the drive gear 3B, and the line passing through the center of the intermediate gear 4BY and the center of the drive gear 3Y is the same as θ1.

The value of θ1 can be approximated based on an addendum modification coefficient of the drive gears 3 and the corresponding intermediate gears 4 using the following expression:

$$\theta 1=(360^\circ/Zi)\times n1$$

where the coefficient n1 is a natural number obtained by, for example, experiment. With this approximation, the distance Dg between the center points of the drive gears and their corresponding intermediate gear defined below is:

$$Dg=(dwp+dwi)/2$$

Similarly, an angle of intersection θ2 between the lines passing through the center of the source gear 10 and the center of the intermediate gears 4BY and 4MC, as shown in FIG. 5, is approximated in the expression below based on an addendum modification coefficient of the source gear 10 and intermediate gears 4BY and 4MC:

$$\theta 2=(360^\circ/Zm)\times n2$$

where Zm is the number of teeth on the source gear and the coefficient n2 is a natural number obtained by, for example, experiment.

It should be noted that the addendum modification coefficient is used to determine the diameter of the pitch circle for a gear. If the addendum modification coefficient is 0, the pitch circles of each engaging gear contact each other. If the coefficient is in a plus range, a profile shifted gear is made so that each center of the gear moves away and the pitch circles for both gears are separated. Thus, if the addendum modification coefficient is in a plus range, the gear is made by a gear cutter positioned relatively far from the center of the gear being made and the shape of the gear is made fat-shaped. If the coefficient is in a minus range, a profile shifted gear is made so that each center of the gear approach and both of the pitch circles slightly overlap. Thus, if the addendum modification coefficient is in a minus range, the gear cutter is positioned relatively close to the center of the gear being made and the shape of the gear is made slim-shaped.

With the gear arrangement on FIG. 5, all of the drive gears 3 can rotate in phase. Further, if the distance Lp between the shafts of adjacent photoconductive elements (e.g. 1C and 1Y) is set according to the following expression:

$$Lp=(dp\times\pi/Zp)\times n3$$

(where dp is the diameter of the photoconductive elements, Zp is the number of teeth on the drive gears, and the coefficient n3 is a natural number obtained by, for example, experiment), further reductions in the visibility of deviations in the toner distribution can be achieved, even if an unevenness of pitch appears on the recording sheet 15 caused by rotational unevenness of the photoconductive elements. In this instance, deviations in the toner distribution are not visible because the unevenness of the pitch occurs in phase.

An example of dimensions for the construction of FIG. 5 will now be described. In this example, the diameter dp of each photoconductive element 1 is 30 mm, and the distance Lp between adjacent shafts of the photoconductive elements represented by the expression Lp=dp×π is 94.2 mm. Further, the number of teeth of the drive gears, intermediate gears and the source gear 10, the addendum modification coefficient for each gear, and the diameter of pitch circle engagement for each gear are provided in table 1, with the module set to 0.5 mm.

| GEAR | NUMBER OF TEETH ON GEARS | ADDENDUM MODIFICATION COEFFICIENT | DIAMETER OF PITCH CIRCLE |
|---|---|---|---|
| Drive gears | Zp = 320 | +0.0124 | +160.017 mm |
| Intermediate gears | Zi = 160 | +0.0124 | +80.008 mm |
| Source gear | Zm = 80 | 0 | 40.0 mm |

In this example, the natural number n1 is 46, n2 is 23, and n3 is 320. From table 1, the following data is obtained: dwp=160.017, dwi =80.008 mm, Lp=(300×π/320)×320= 94.2 mm. The approximated value for θ1 is determined as follows:

$$\theta 1=(360^\circ/Zi)\times n1$$

$$\theta 1=(360^\circ/160)\times 46=103.5^\circ$$

Further, the approximated value for θ2 is calculated as follows:

$$\theta 2=(360^\circ/Zm)\times n2$$

$$\theta 2=(360^\circ/80)\times 23=103.5^\circ$$

Figure 6:
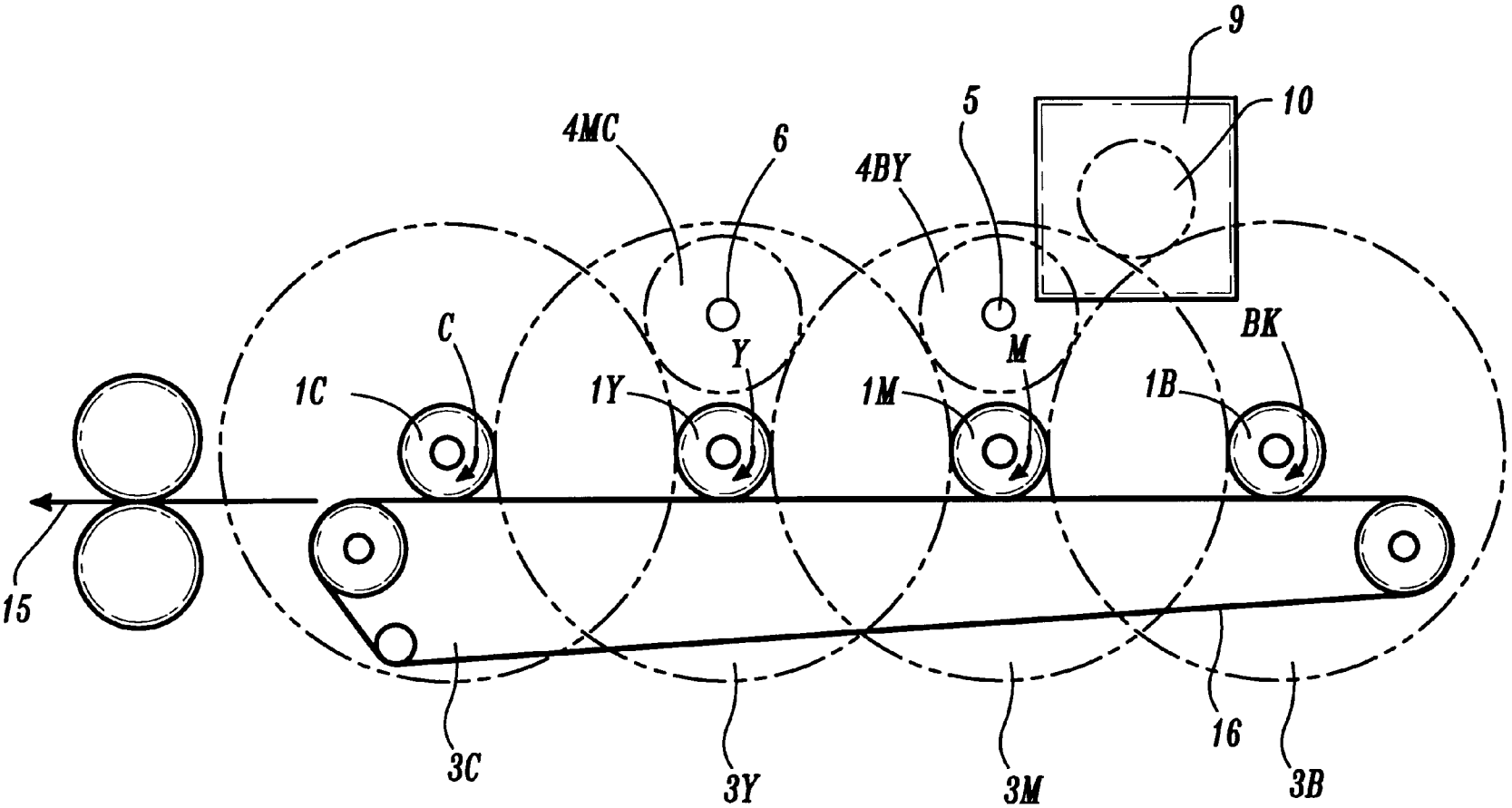
FIG. 6 is a side elevational view of the drive power transmission mechanism of the color image forming apparatus according to another embodiment of the present application.
Figure 7:
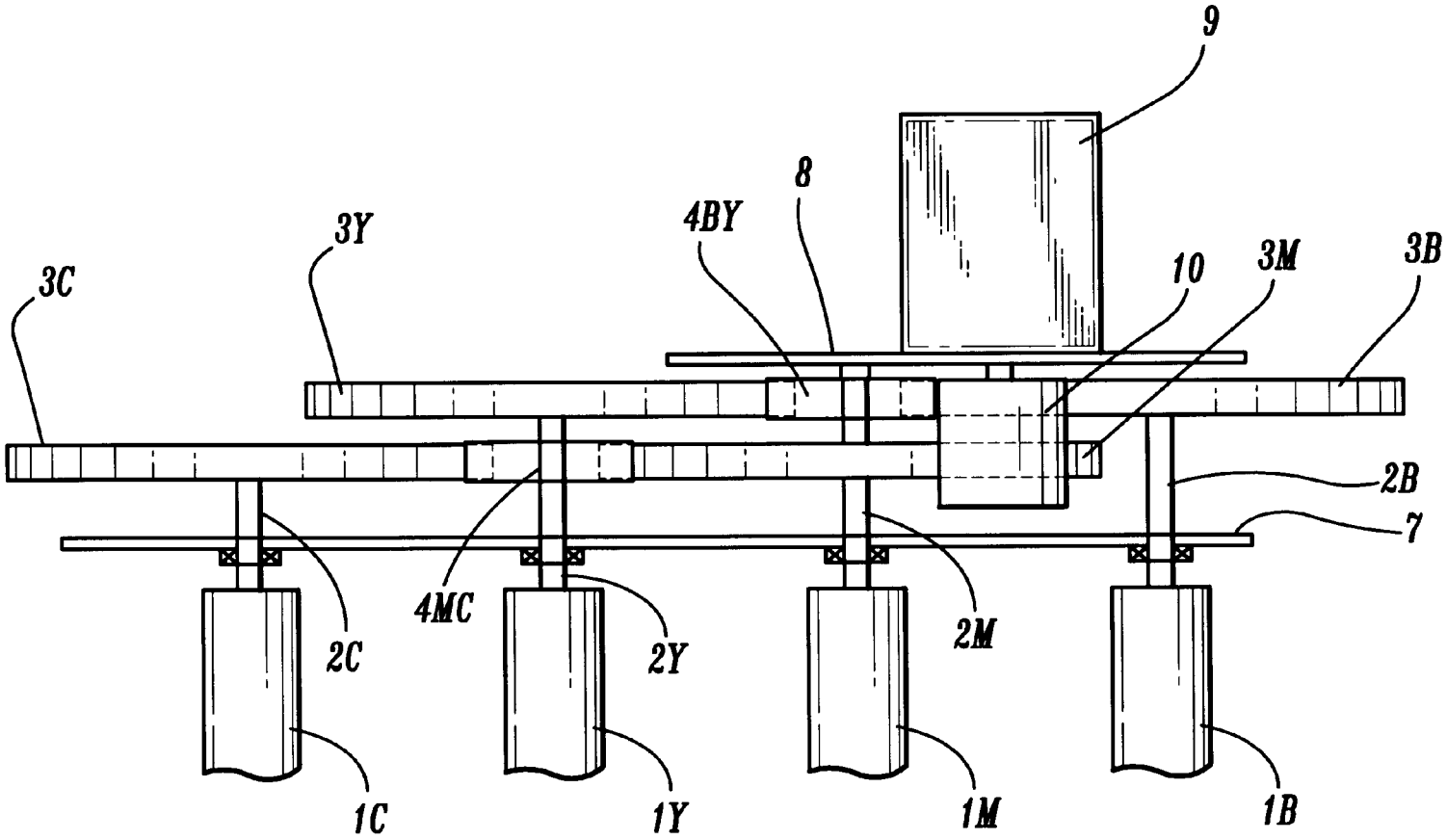
FIG. 7 is a top plan view of the drive power transmission mechanism of FIG. 6.
Figure 8:
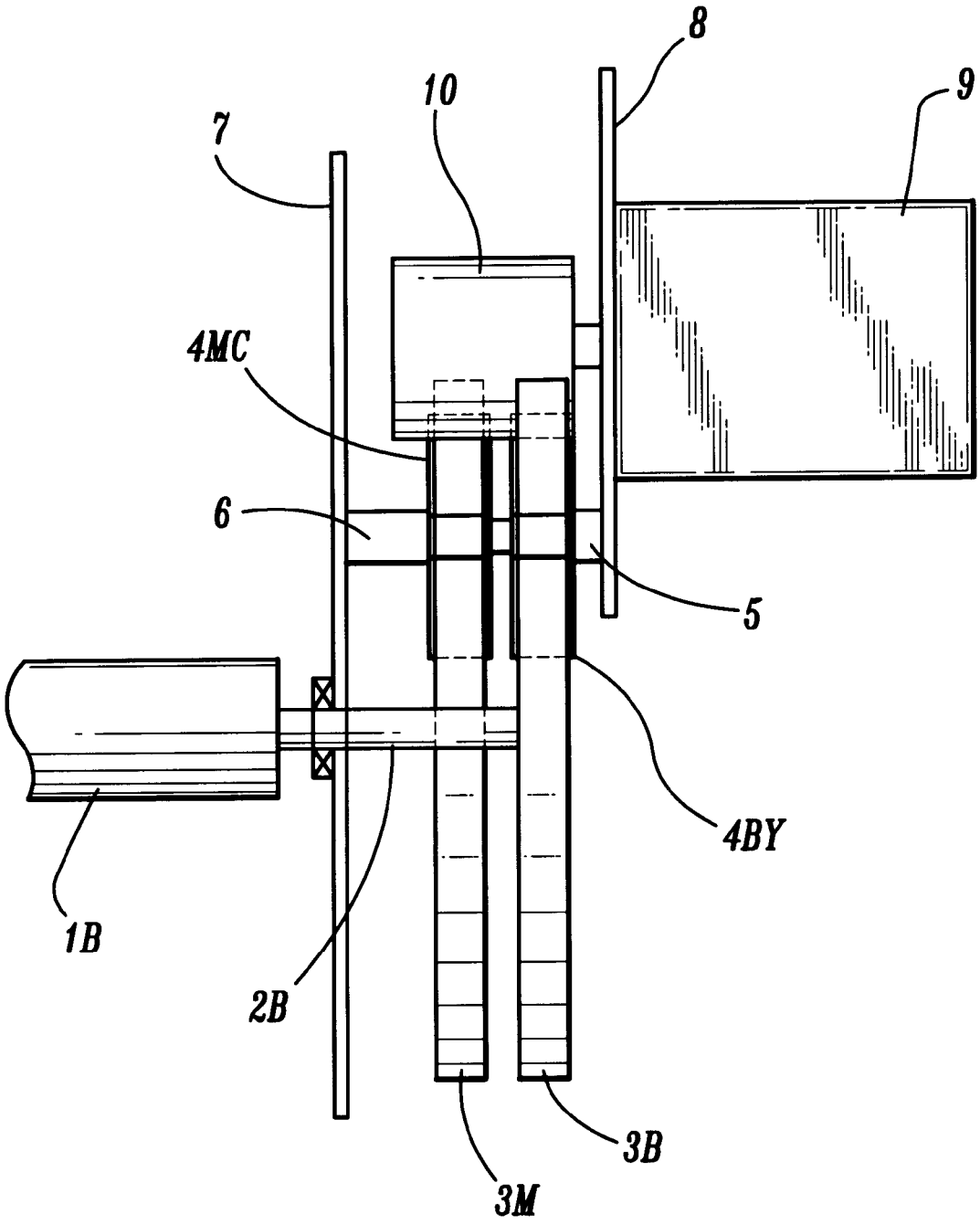
FIG. 8 is a front elevational view of the drive power transmission mechanism of FIG. 6.

Referring to FIGS. 6–8, a second embodiment for the drive power transmission mechanism is shown. The construction of the color image forming apparatus relating this second embodiment is similar to the construction of FIG. 1 of the first embodiment.

Comparing the drive power transmission mechanism of this second embodiment with the drive power transmission mechanism of the first embodiment, it can be seen that the positioning of the gears, the motor 9 and the source gear 10 differ. As shown in FIGS. 6 and 7, the motor 9 is secured to the drive unit side plate 8, and source gear 10 engages drive gear 3B and drive gear 3M at the same time. Therefore, when the motor 9 rotates, the rotation of the drive gear 3B is transmitted to the drive gear 3Y through the intermediate gear 4BY, and the rotation of the drive gear 3M is transmitted to the drive gear 3C through the intermediate gear 4MC.

According to the drive power transmission mechanism as described above, the drive gears 3 synchronously rotate so that the photoconductive elements 1 rotate at the same time. Further, in this embodiment, since the first and second drive power transmission groups are offset relative to the main body side plate 7 as seen in FIG. 7, the diameter of each drive gear 3 can be larger than the distance Lp between the shafts of adjacent photoconductive elements. As a result, high quality color images can be obtained as with the first embodiment but the working area for the photoconductive elements is reduced.

In the drive power transmission mechanism of the color image forming apparatus of the above described second embodiment, the relationship of the distance Lp between adjacent shafts of the photoconductive elements, the diameter (dap) of the addendum circle of the drive gears, the diameter (dwp) of the pitch circle of the drive gears, the diameter (dwi) of the pitch circle of the intermediate gears, the diameter (dsp) of the shafts of the photoconductive elements, and the diameter (dsi) of the shaft of the intermediate gears may be represented by the following inequalities, so that the shafts of the intermediate gears and the shafts of the drive gears do not interfere with each other:

$$Lp>dap/2+dsp/2$$

$$(dap/2+dsi/2)<Lx$$

where $Lx=[(dwp/2+dwi/2)^2-Lp^2]^{1/2}$ which is the distance between the shafts 5 or 6 of the intermediate gears 4BY or 4MC and the shafts 2M or 2Y of photoconductive elements 1M or 1Y.

Figure 9:
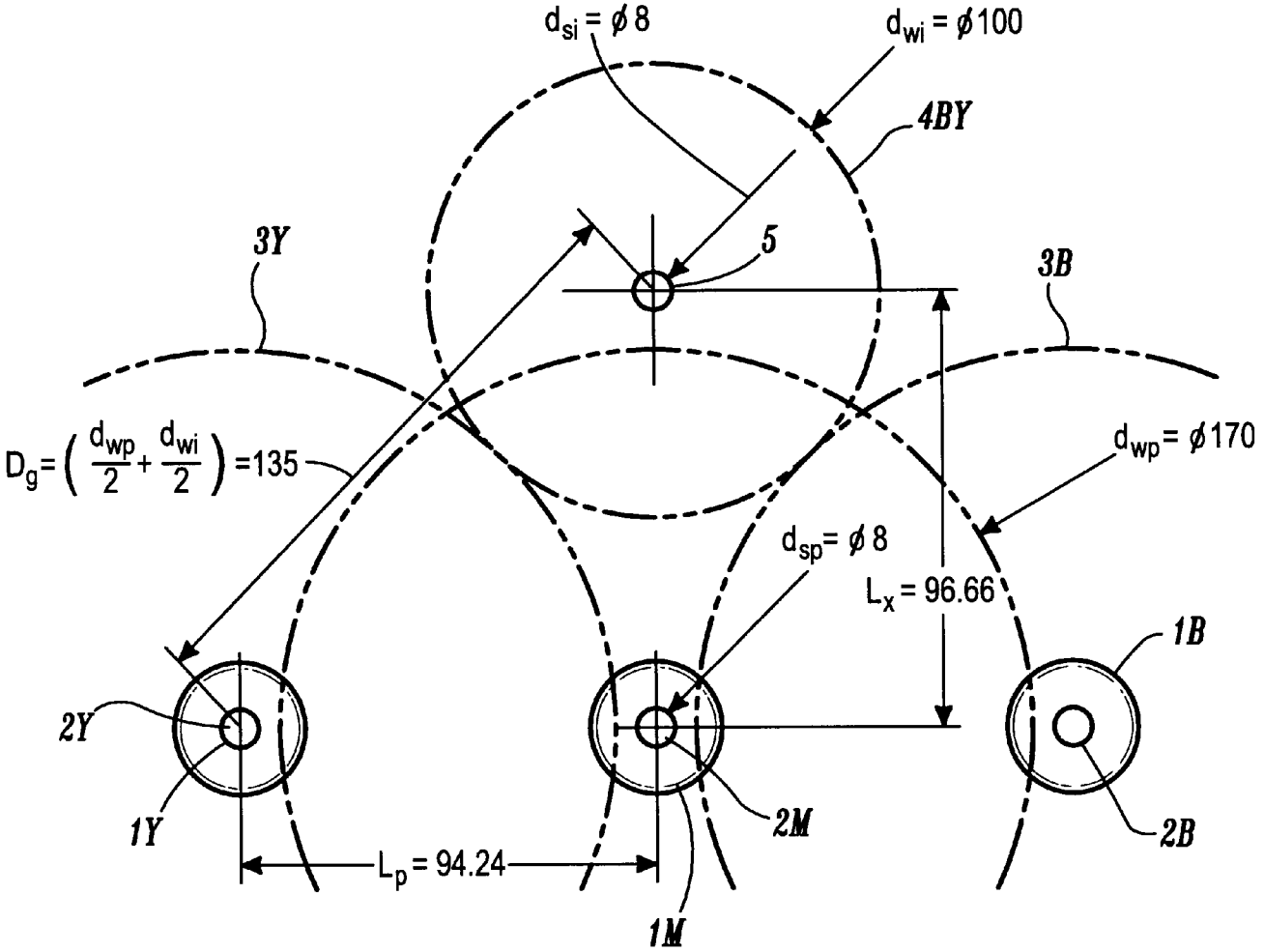
FIG. 9 is a partial schematic representation of the drive power transmission mechanism illustrating a gearing configuration in which a shaft of an intermediate gear does not interfere with a gear of a photoconductive element.

FIG. 9 is an enlarged portion of the drive power transmission mechanism illustrating a gear configuration where a shaft of an intermediate gear does not interfere with the shafts of the drive gears. At FIG. 9, for example, assume that the diameter of the photoconductive element 1B is 30 mm, and the distance Lp between the shafts of adjacent photoconductive elements is 94.24 mm. If the module of the diameter (dwp) of the pitch circle is 0.5, the diameter (dap) of the addendum circle of the drive gears 3B and 3Y are determined to be 170 mm. Further, assuming that the diameter (dwi) of the pitch circle of the intermediate gear 4BY is 100 mm, the diameter (dsp) of the shafts 2B and 2Y of the photoconductive elements 1B and 1Y is 8 mm, the diameter (dsi) of each shaft 5 and 6 of the intermediate gears 4BY and 4MC is 8 mm. With these values the aforementioned inequalities are satisfied as follows:

$$Lp>dap/2+dsp/2$$

$$94.24>85.5+4$$

$$94.24>89.5$$

$$(dap/2+dsi/2)<Lx$$

$$(85.5+4)<[(0.25+50)^2-94.24^2]^{1/2}$$

$$89.5<96.66$$

Figure 10:
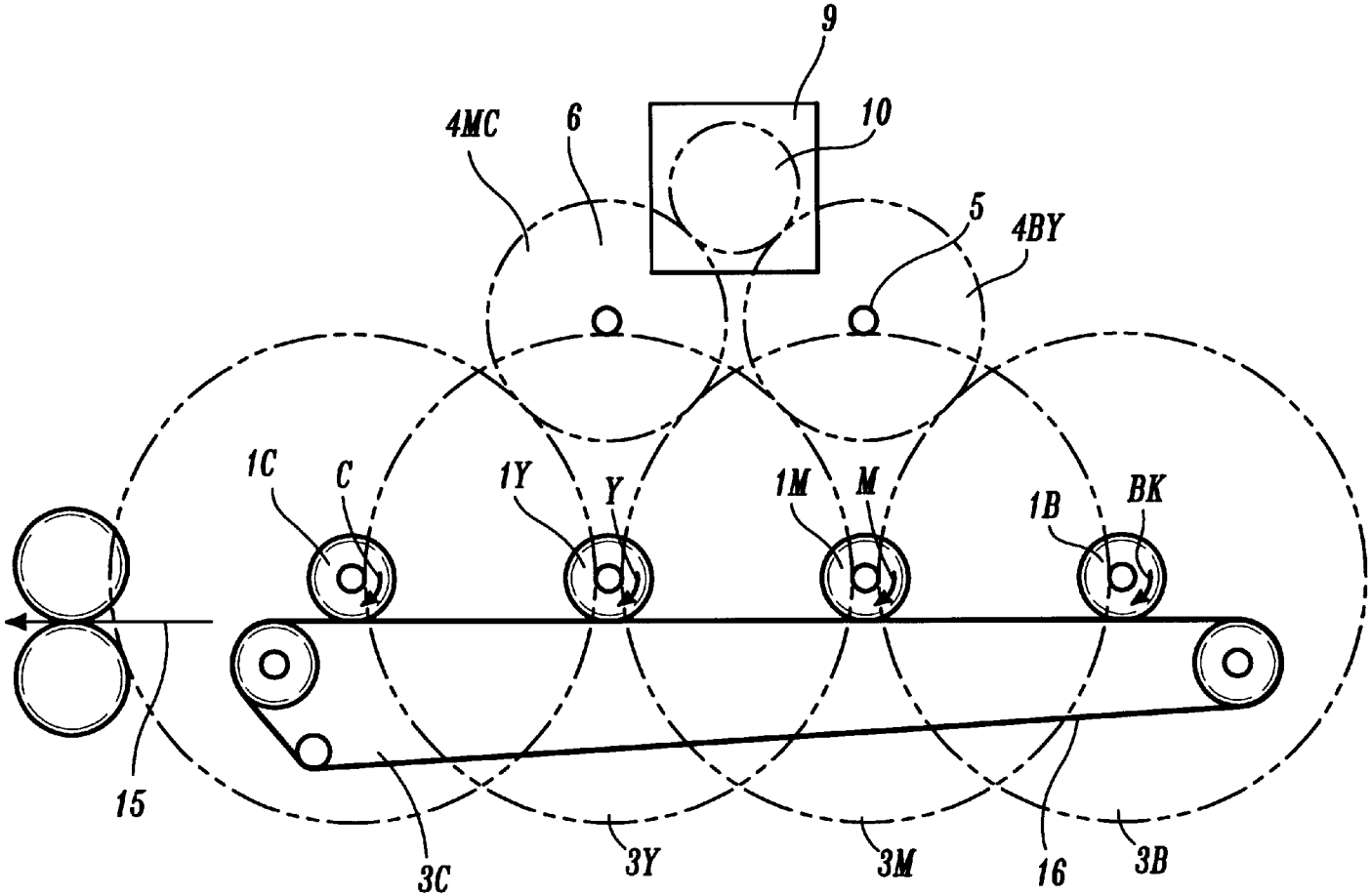
FIG. 10 is a side elevational view of the drive power transmission mechanism according to another embodiment of the present application.
Figure 11:
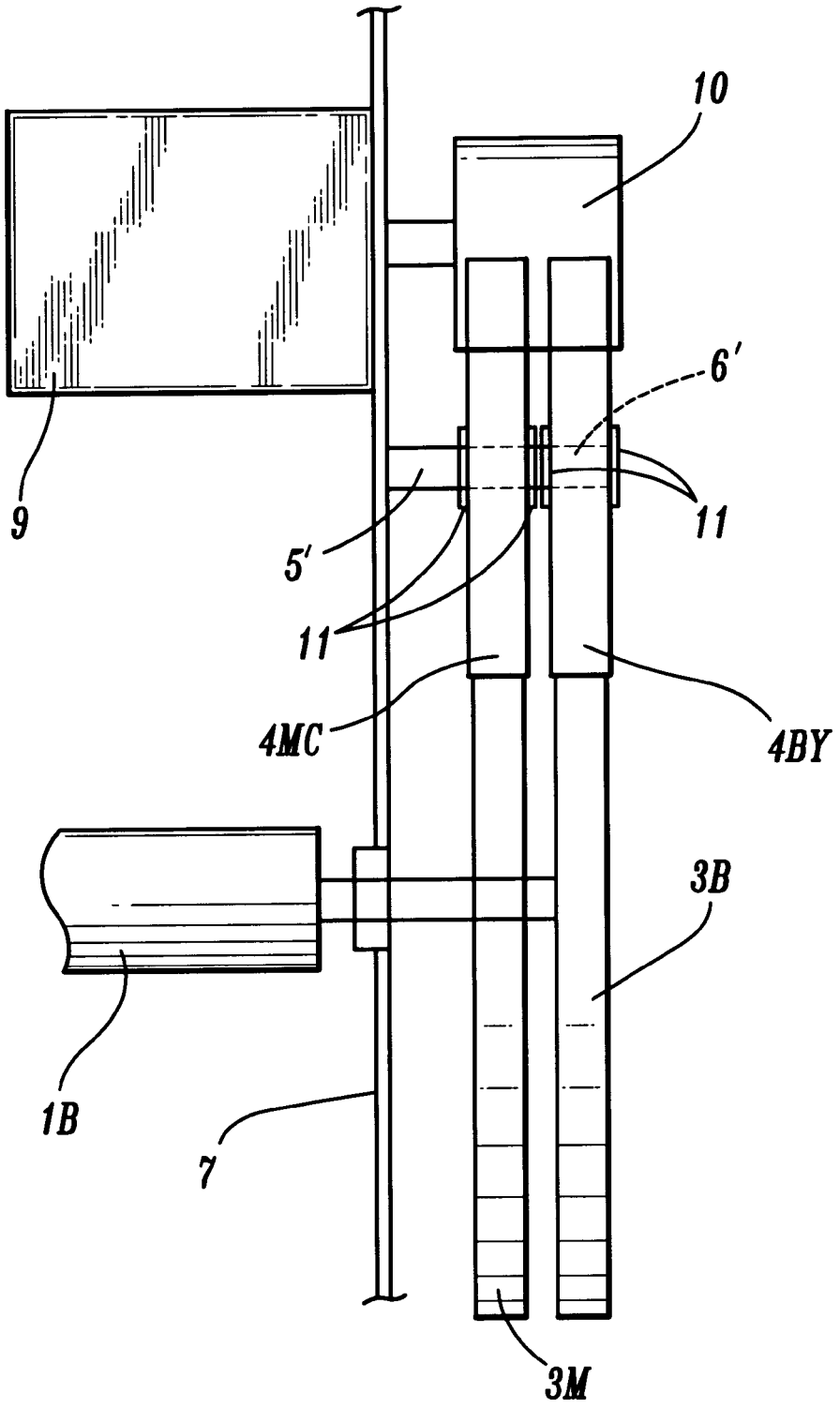
FIG. 11 is a front elevational view of the drive power transmission mechanism of FIG. 10.

By setting the distance Lp between the shafts of adjacent photoconductive elements as shown in FIGS. 9 and 10, Lx is determined to be 96.66, so that the elements gears 3M or 3Y do not interfere the shafts 5 or 6 of the intermediate gears 4BY or 4MC. Therefore, as shown in FIG. 11, the shafts 5 and 6 of the intermediate gears 4BY and 4MC can be mounted to the side of the main body side plate 7 and the gears are rotatably mounted to the shafts using stopping rings 11. This results in a more efficient and economical assembling process when compared to the configuration of FIG. 4 where the shafts 5 and 6 of the intermediate gears 4MC and 4BY are mounted to both of the main body side plate 7 and the drive unit side plate 8.

A third embodiment of the drive power transmission mechanism of the color image forming apparatus according to the present application will now be described with reference to FIGS. 12–14. The construction of the color image forming apparatus according to this embodiment is similar to the construction of the first embodiment shown in FIG. 2. Therefore, a discussion of like elements is omitted.

Figure 12A:
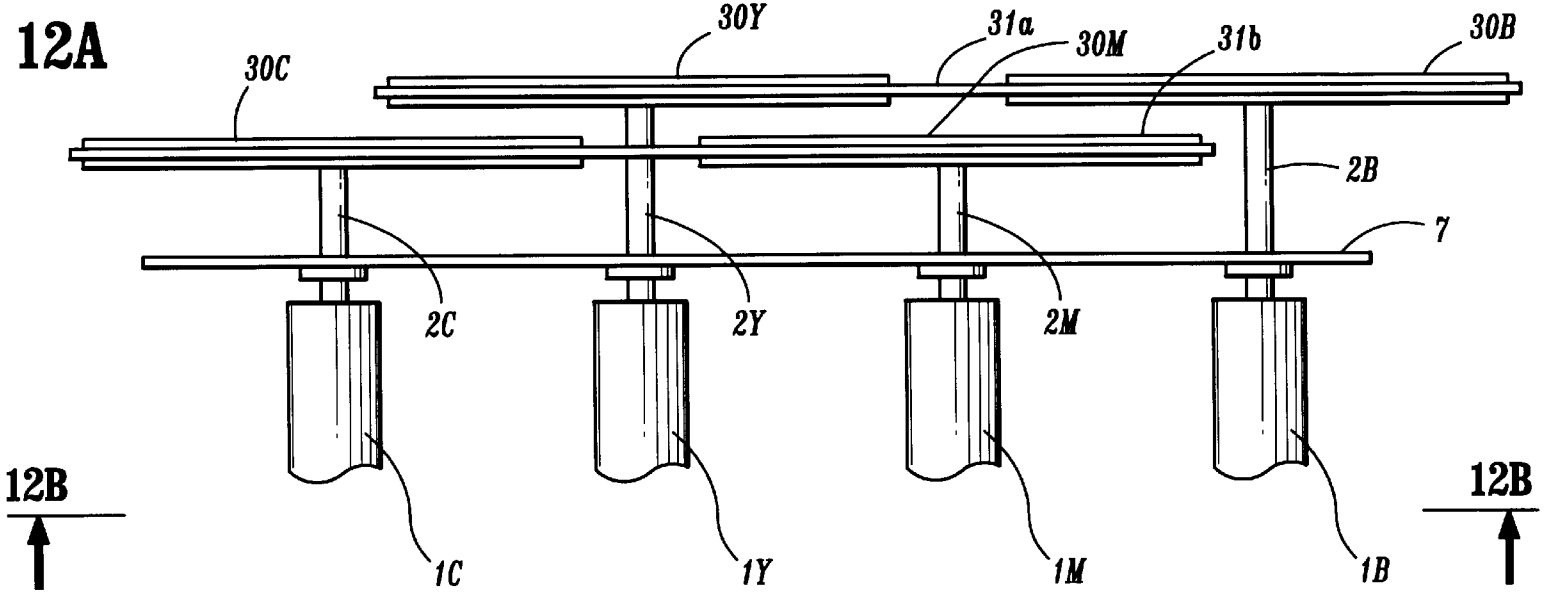
FIG. 12(A) is a top plan view of the drive power transmission mechanism of the color image forming apparatus according to another embodiment of the present application.
Figure 12B:
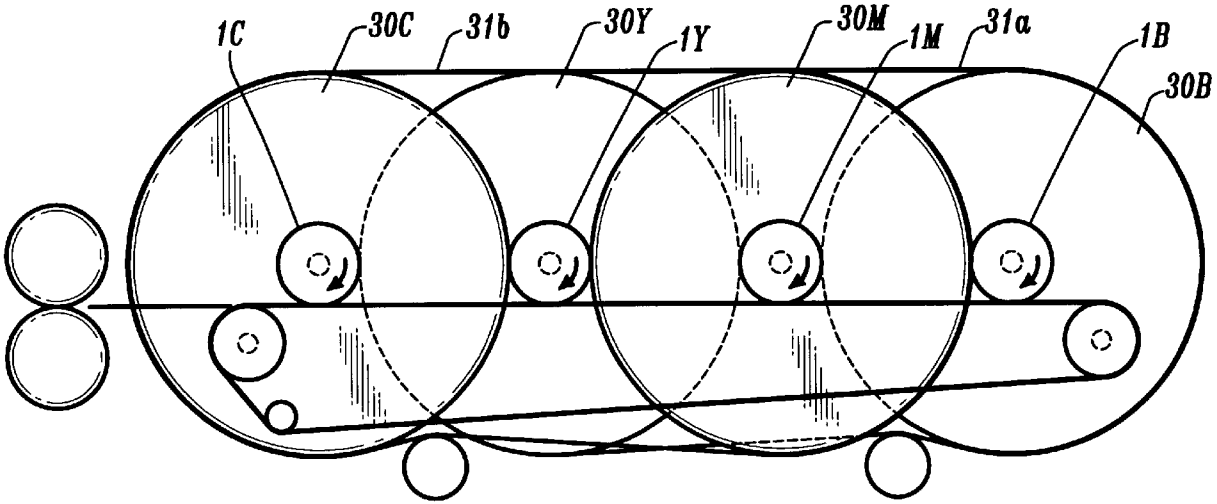
FIG. 12(B) is a side elevational view of FIG. 12(A) taken from line B—B.

Referring to FIGS. 12(A) and 12(B) timing belt pulleys 30 are mounted on shafts 2 of the photoconductive elements 1, and used in the drive power transmission members for the photoconductive elements. The timing belt pulleys 30 are offset from the main body plate 7 in groups as shown in FIG. 12(A) so that the timing belt 31*a* is used to rotate one group of the photoconductive elements 1 and timing belt 31*b* is used to rotate the other group. One group of timing belt pulleys may include the odd numbered pulleys in the order counting from right to left, i.e., the first color pulley 30B and the third color pulley 30Y. The other group of timing belt pulleys may include the even numbered pulleys in order from right to left., i.e., the second color pulley 30M and the fourth color pulley 30C.

According to this construction, the diameter of each timing belt pulley 30 can be made large without limiting the diameter of the shafts 2 of adjacent photoconductive elements 1. Using pulleys 30 with large diameters increases the number of the teeth on each pulley and on the timing belt so that the cycle of unevenness of the image caused by the engagement of the teeth on the belt with the teeth on the pulley is reduced to a level which is not visible.

For example, in a case where the diameter of the photoconductive elements 1 is 30 mm, and the distance between adjacent shafts of the photoconductive element is 94.2 mm, the diameter of each timing belt pulley 30 would correspond to $\phi$ 152.8 mm, and the number of teeth on each pulley could be as high as 240, for a timing belt having a 2 mm pitch. Even though an unevenness of the toner distribution due to the engagement of the timing belt with the timing belt pulley 30 may occur, the interval of unevenness of the distribution of the toner is $30\times\pi/240$ or 0.39 mm so that the spatial frequency is 1/0.39 or 2.54 Hz/mm. As a result, the unevenness of toner distribution is not visible since the unevenness becomes visible at a spatial frequency of about 1 Hz/mm or less.

Figure 13A:
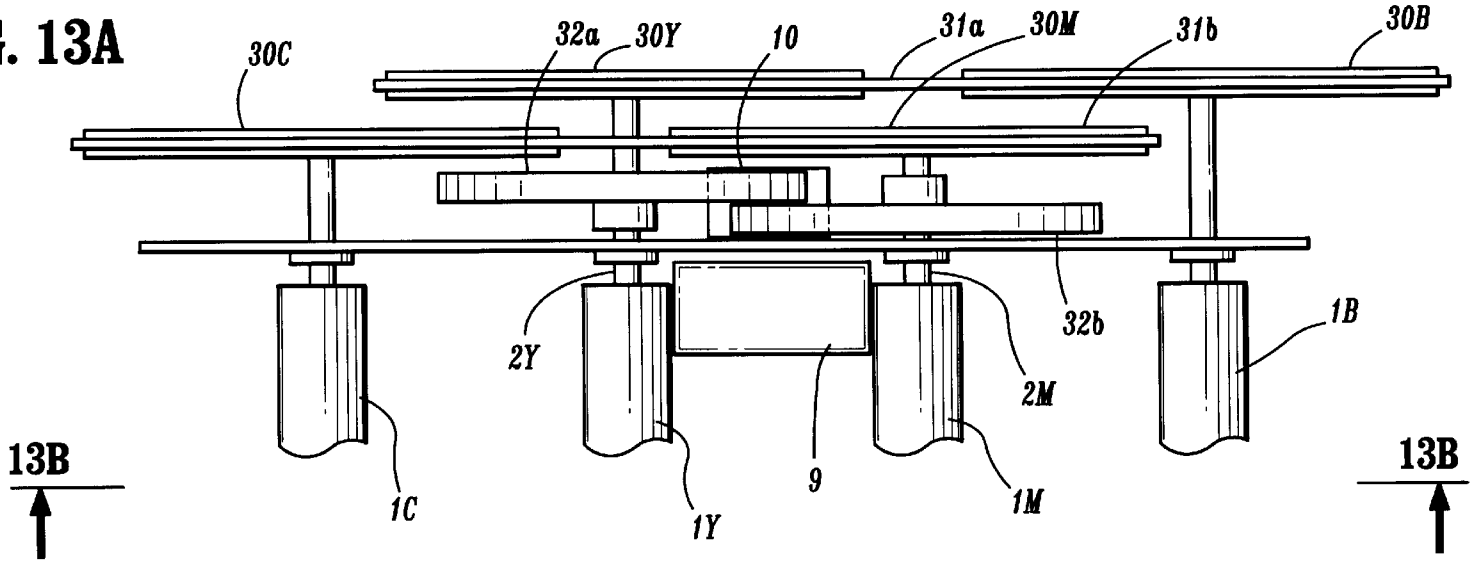
FIG. 13(A) is a top plan view showing an embodiment of the drive power transmission mechanism.
Figure 13B:
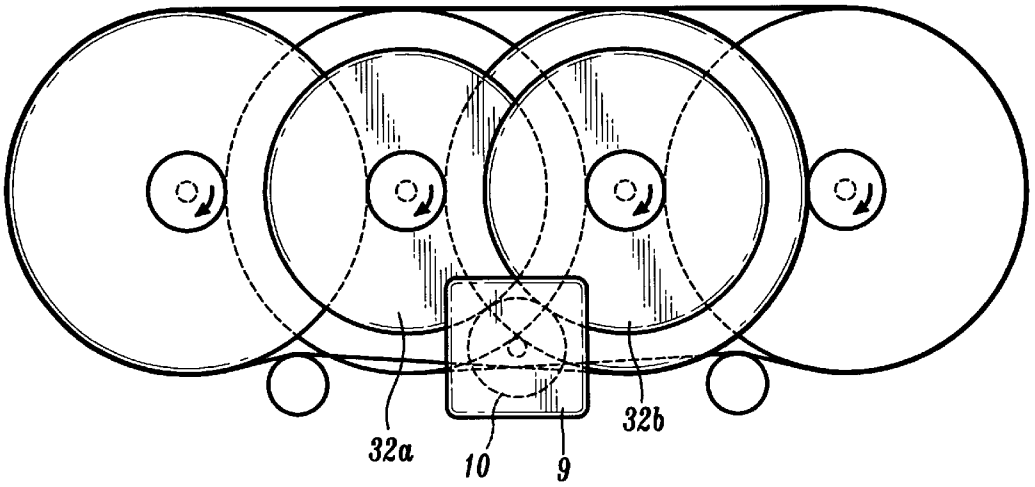
FIG. 13(B) is a side elevational view of FIG. 13(A) taken from line B—B.

FIGS. 13(A) and 13(B) are top plan and side elevational views showing an embodiment of the drive power transmission mechanism which transmits power from a drive power source, such as motor 9, to the photoconductive elements 1. In this embodiment, the drive power transmission mechanism includes a drive power output member, such as source gear 10, mounted on the motor 9. Driven gears 32*a* and 32*b* used as drive power input members are mounted on the shafts 2M and 2Y of photoconductive elements 1M and 1Y, respectively. In the embodiment of FIG. 13, the driven gears 32*a* and 32*b* used are spur gears with a module of 1 mm and 120 teeth (the diameter of the pitch circle $\phi$ =120 mm). Further, banding that may occur due to a difference between frequencies of vibration due to the engagements between the driven gears 32*a* and 32*b* and the timing belt pulley 30 is reduced by having a ratio of the number of the teeth of the driven gears 32*a* and 32*b* and the number of the teeth of the timing belt pulleys 30 (240 teeth) to be about ½ an integral ratio. However, if the module is 0.5 and a torque of the load is reduced to be as small as possible, an integral ration of about 1/1 can be achieved so that further reduction in banding is obtained. In addition, in this embodiment, a spur gear is used as the aforementioned driven gears 32*a* and 32*b*, however, helical gears may be employed for reducing vibration.

Figure 14A:
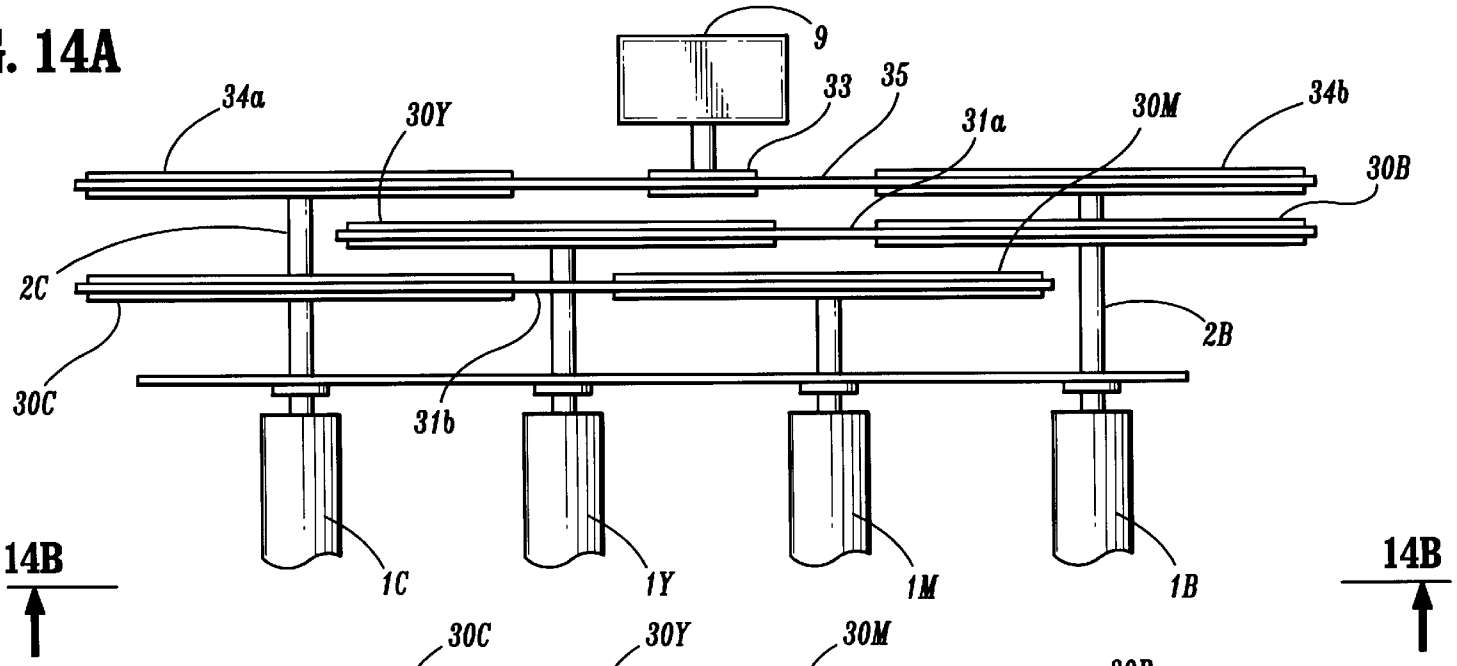
FIG. 14(A) is a top plan view showing another embodiment of the drive power transmission mechanism.
Figure 14B:
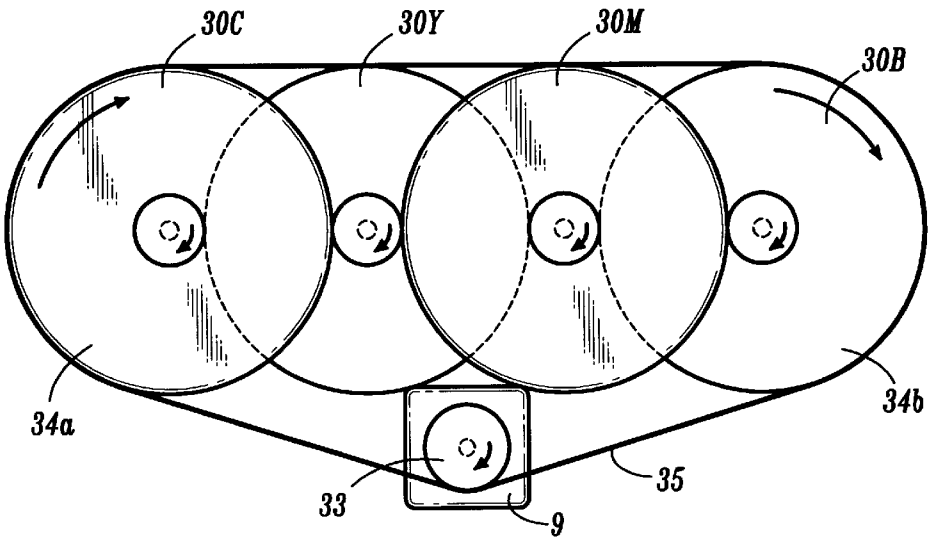
FIG. 14(B) is a side elevational view of FIG. 14(A) taken from line B—B.
Figure 15:
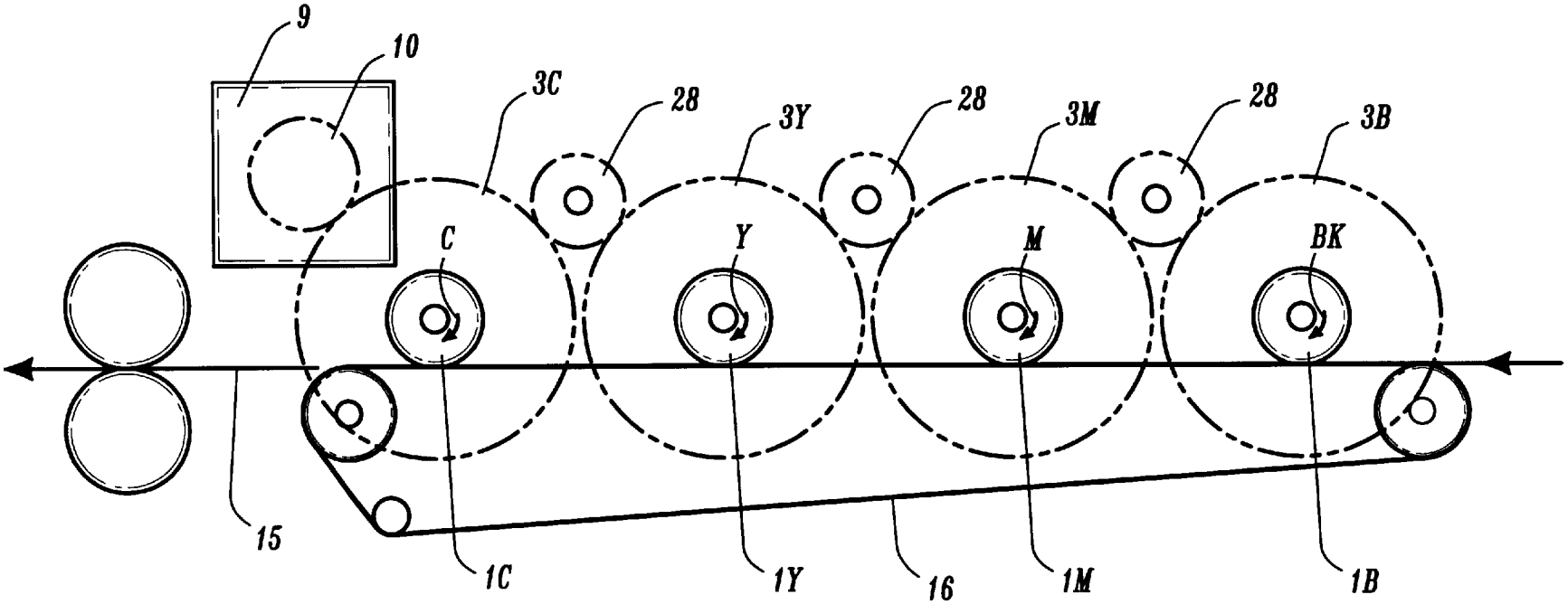
FIG. 15 (Prior Art)
FIG. 15 is side elevational view of a conventional drive power transmission mechanism.
Figure 16:
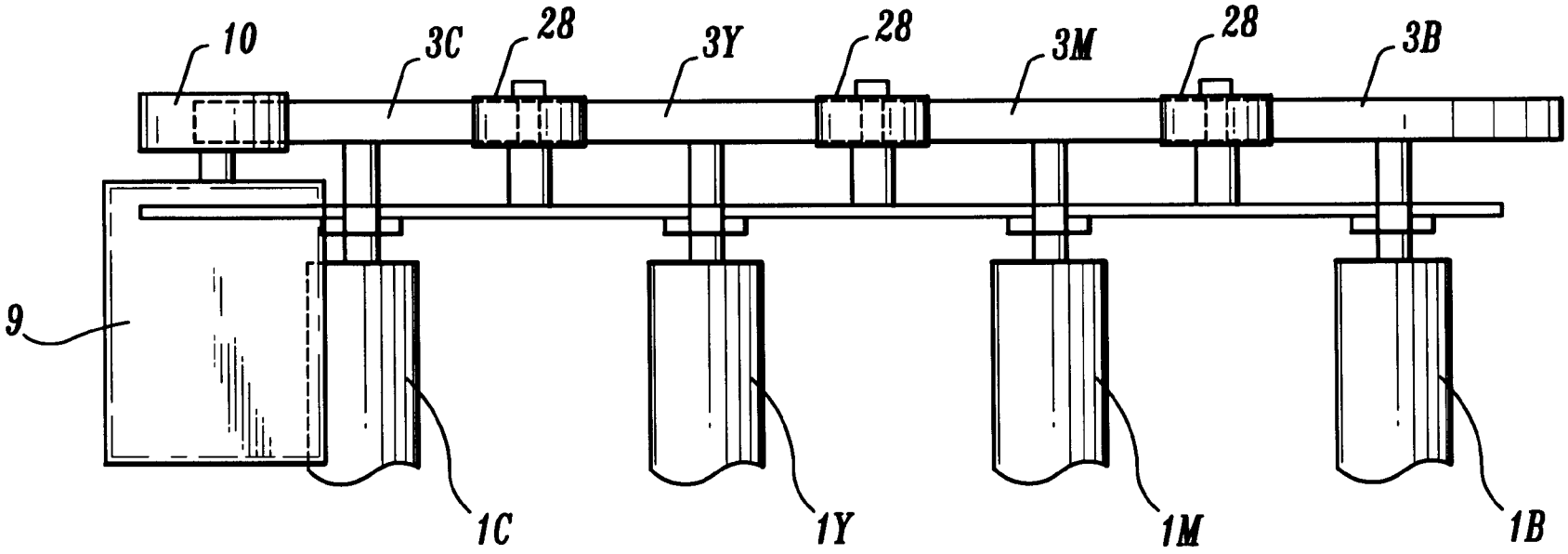
FIG. 16 (Prior Art)
FIG. 16 is a top plan view of the drive power transmission mechanism of FIG. 15.
Figure 17:
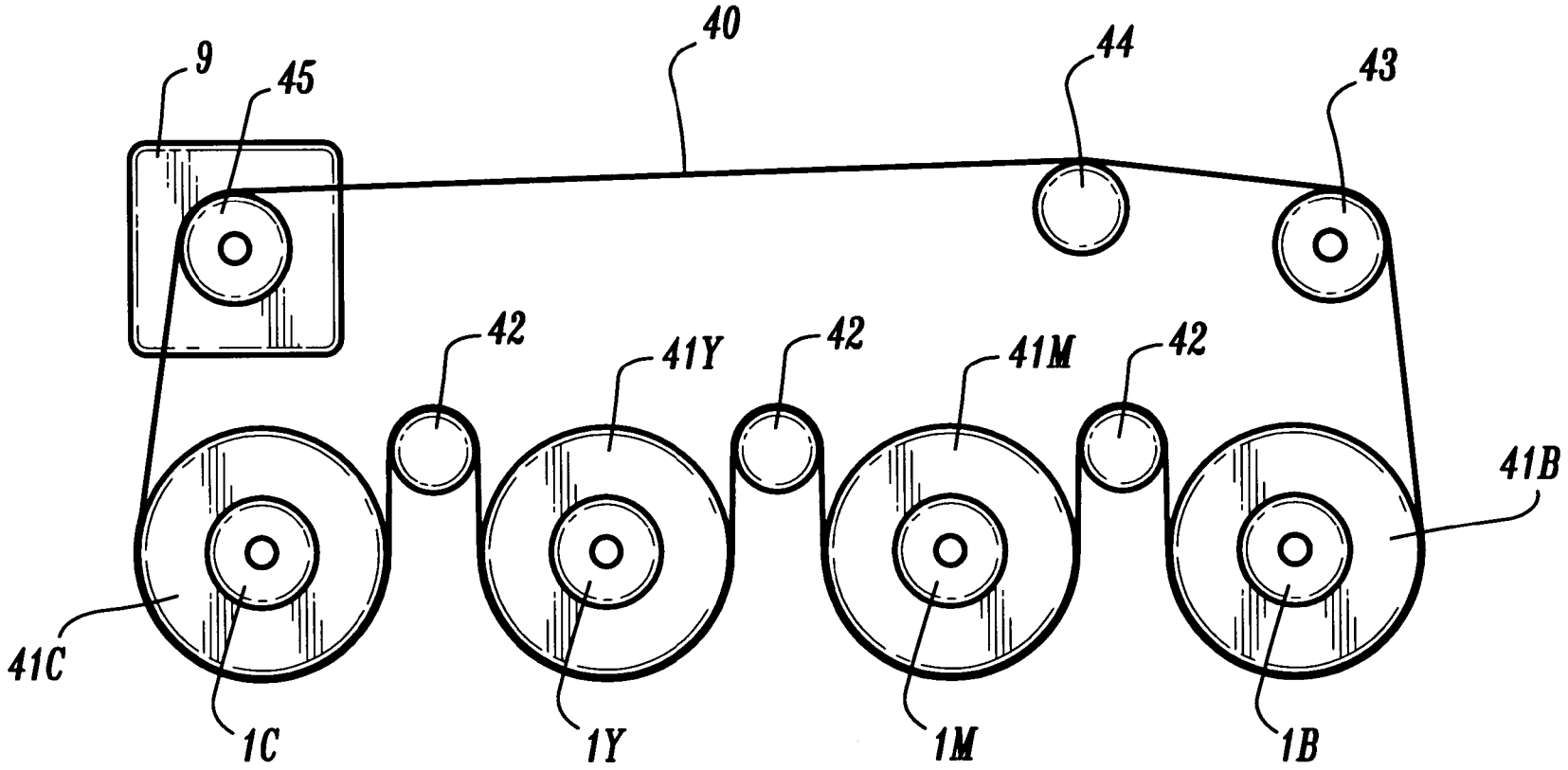
FIG. 17 (Prior Art)
FIG. 17 is a side elevational view of another conventional drive power transmission mechanism.

FIGS. 14(A) and 14(B) are top plan and side elevational views showing another embodiment of the drive power transmission mechanism, which transmits the rotational power of the motor 9 to the photoconductive elements 1. In this embodiment, the drive power transmission mechanism is composed of a drive pulley 33 and two timing belt pulleys

34*a* and 34*b* used as drive power input members. One pulley is mounted on the shaft 2B of the first color photoconductive element 1B, and the other pulley is mounted on the shaft 2C of the fourth color photoconductive element 1C. The timing belt pulleys 34*a* and 34*b* have the same diameter and the same number of the teeth as the timing belt pulleys 30 described above. In this embodiment, rotational drive power is transmitted to the timing belt pulleys 30, timing belt 35 and the drive pulley 33. If the diameter and number of the teeth for each timing belt pulley 34*a* and 34*b* and each timing belt pulley 30 are determined as described above, the frequency of the vibration caused by engagement of the pulleys 34*a* and 34*b* and 30 becomes equal so that banding is reduced.

Having now fully described the invention, it will be apparent to one of ordinary skill in the art that many changes and modifications can be made thereto without departing from the spirit and scope of the invention as set forth herein.

This application is based on Japanese Patent Application Nos. 09-132822 filed on May 6, 1997, 08-314185 filed on Nov. 11, 1996, and 09-070795 filed on Mar. 8, 1997, the entire contents of each application are incorporated herein by reference.

What is claimed is:

1. An image forming apparatus comprising:

a plurality of image bearing members disposed along a conveying direction of a recording sheet; and a drive power transmission mechanism intermediate of said plurality of image bearing members and a drive source, and configured to translate movement of said drive source to movement of said plurality of image bearing members, said drive power transmission mechanism having a first group of drive power transmission members and a second group of drive power transmission members, wherein each member of said first and second groups corresponds to one of said plurality of image bearing members, and wherein said first and second groups are arranged such that a member of said first group is adjacent a member of said second group, and such that said groups are offset relative to each other so that said drive power transmission members of said groups provide synchronized movement of said plurality of image bearing members, wherein said drive power transmission mechanism includes a first intermediate drive power transmission member that couples said drive power transmission members of said first group to said drive source, and a second intermediate drive power transmission member that couples said drive power transmission members of said second group to said drive source.

2. The image forming apparatus according to claim 1, wherein said plurality of image bearing members are arranged in series and parallel to each other.

3. The image forming apparatus according to claim 1, wherein said first and second intermediate drive power transmission members are coupled to said drive source by a source transmission member.

4. The image forming apparatus according to claim 1, wherein said drive source rotates and rotational movement of said drive source is translated to rotational movement of each of said first and second intermediate drive power transmission members, and wherein rotational movement of said intermediate drive power transmission members is translated to rotational movement of said drive power transmission members.

5. The image forming apparatus according to claim 4, wherein each drive power transmission member is secured to a shaft of a corresponding image bearing member.

6. The image forming apparatus according to claim 1, wherein each drive power transmission member comprises a drive gear secured to a corresponding image bearing member, and wherein each of said first and second intermediate drive power transmission members comprises an intermediate gear engaged with said drive power transmission members.

7. The image forming apparatus according to claim 1, wherein a relationship between one of said groups of drive power transmission members and said corresponding intermediate drive power transmission member is defined by:

$$\theta 1=2\times[90^\circ-\cos^{-1}[Lp/\{(dwp+dwi)/2\}]]$$

wherein Lp is a distance between adjacent shafts of said image bearing members, dwp is a diameter of a pitch circle of each drive power transmission member and dwi is a diameter of a pitch circle of said first and second intermediate drive power transmission members.

8. The image forming apparatus according to claim 1, wherein a relationship between each of said first and second intermediate drive power transmission members and said drive source is defined by a predefined angle relative to said first and second intermediate drive power transmission member and said drive source.

9. The image forming apparatus according to claim 8, wherein said drive source includes a source gear.

10. The image forming apparatus according to claim 9, wherein said predefined angle is approximated as an integral multiple of the quotient of 360° and a number of teeth on said source gear.

11. The image forming apparatus according to claim 10, wherein said approximated predefined angle is defined by:

$$\theta 2=(360^\circ/Zm)\times n2$$

wherein Zm is the number of teeth on said source gear and n2 is a natural number.

12. The image forming apparatus according to claim 9, wherein said predefined angle is defined by two intersecting lines, wherein a first line connects a center of one of said first and second intermediate drive power transmission members and a center of said source gear, and wherein a second line connects a center of another of said first and second intermediate drive power transmission members and said center of said source gear.

13. The image forming apparatus according to claim 1, wherein each drive power transmission member is a drive gear and each said first and second intermediate drive power transmission member is an intermediate gear.

14. An image forming apparatus comprising:

image bearing means disposed along a conveying direction of a recording sheet; and drive power transmission means intermediate of said image bearing means and drive source means, and configured to translate movement of said drive source means to movement of said image bearing means, said drive power transmission means being divided into groups, wherein said groups are arranged in an alternating relationship and are offset relative to each other so as to provide synchronized movement of said image bearing means, wherein said image bearing means comprises four image bearing members and said drive power transmission means comprises:

four drive gears wherein two of said drive gears form a first group and two of said drive gears form a second group; and two intermediate gears, wherein one of said intermediate gears corresponds to said first group and one of said intermediate gears corresponds to said second group.

15. The image forming apparatus according to claim 14, wherein said four image bearing members are arranged in series and parallel to each other.

16. The image forming apparatus according to claim 14, wherein said two intermediate gears engage a source gear on said drive source, such that rotation of said source gear is translated to rotational movement of said two intermediate gears and rotational movement of said two intermediate gears is translated to said four drive gears.

17. The image forming apparatus according to claim 14, wherein each drive gear is secured to a shaft of said corresponding image bearing member.

18. The image forming apparatus according to claim 17, wherein a distance between shafts of adjacent image bearing members is based on the circumferential length of said image bearing members.

19. The image forming apparatus according to claim 14, wherein a relationship between said first group of said drive gears and said corresponding intermediate gear is defined by a predefined angle.

20. The image forming apparatus according to claim 19, wherein said predefined angle is approximated as an integral multiple of the quotient of 360° and a number of teeth on said drive gear in said first group.

21. The image forming apparatus according to claim 19, wherein said predefined angle is defined by two intersecting lines, wherein a first line connects said center of one of said drive gears in said first group and a center of said corresponding intermediate gear, and wherein a second line connects a center of another of said drive gears in said first group and said center of said corresponding intermediate gear.

22. The image forming apparatus according to claim 14, wherein a relationship between said second group of said drive gears and said corresponding intermediate gear is defined by a predefined angle relative to said each drive gear in said second group and said corresponding intermediate gear.

23. The image forming apparatus according to claim 22, wherein said predefined angle is approximated as an integral multiple of the quotient of 360° and a number of teeth on one of said drive gears in said second group.

24. The image forming apparatus according to claim 22, wherein said predefined angle is defined by two intersecting lines, wherein a first line connects said center of one of said drive gears in said second group and a center of said corresponding intermediate gear, and wherein a second line connects a center of another of said drive gears in said second group and said center of said corresponding intermediate gear.

25. The image forming apparatus according to claim 14, wherein a relationship between one of said groups of drive gears and said corresponding intermediate gear is defined by:

$$\theta 1=2\times[90^\circ-\cos^{-1}[Lp/\{(dwp+dwi)/2\}]]$$

wherein Lp is a distance between adjacent shafts of said image bearing members, dwp is a diameter of a pitch circle of each drive gear and dwi is a diameter of a pitch circle of said intermediate gears.

26. The image forming apparatus according to claim 14, wherein a relationship between said two intermediate gears and said drive source means is defined by a predefined angle relative to said two intermediate gears and said drive source means.

27. The image forming apparatus according to claim 26, wherein said drive source means includes a source gear.

28. The image forming apparatus according to claim 27, wherein said predefined angle is approximated as an integral multiple of the dividend of 360° and a number of teeth on said source gear.

29. The image forming apparatus according to claim 17, wherein a relationship between said intermediate gears and said source gear is defined by:

$$\theta 2=(360^\circ/Zm)\times n2$$

wherein Zm is a number of teeth on said source gear and n2 is a natural number.

30. The image forming apparatus according to claim 14, wherein said image bearing means comprises a plurality of image bearing members and said drive power transmission means comprises a plurality of drive gears and a plurality of intermediate gears, wherein a predefined number of said plurality of drive gears and at least one of said intermediate gears are included in each of said groups, and wherein a relationship between drive gears in each group and one of said intermediate gears is defined by a predefined angle.

31. The image forming apparatus according to claim 30, wherein said predefined angle is approximated as an integral multiple of the quotient of 360° and a number of teeth on one drive gear in said group.

32. The image forming apparatus according to claim 30, wherein said predefined angle is defined by two intersecting lines, wherein a first line connects a center of one of said drive gears in said group and a center of said one intermediate gear, and wherein a second line connects a center of another drive gear in said group and said center of said one intermediate gear.

33. The image forming apparatus according to claim 30, wherein said predefined angle is defined by:

$$\theta 1=2\times[90^\circ\cos^{-1}[Lp/\{(dwp+dwi)/2\}]]$$

wherein Lp is a distance between adjacent shafts of said image bearing means, dwp is a diameter of a pitch circle of said drive gears and dwi is a diameter of a pitch circle of said intermediate gears.

34. The image forming apparatus according to claim 30, wherein said drive source means comprises at least one source gear, and wherein a relationship between said plurality of intermediate gears and said at least one source gear is defined by a predefined angle.

35. The image forming apparatus according to claim 34, wherein said predefined angle is approximated as an integral multiple of the quotient of 360° and a number of teeth on said source gear.

36. The image forming apparatus according to claim 34, wherein said predefined angle is defined by two intersecting lines, wherein a first line connects a center of one of said intermediate gears and a center of said source gear, and wherein a second line connects a center of another of said intermediate gears and said center of said source gear.

37. The image forming apparatus according to claim 34, wherein a relationship between said intermediate gears and said source gear is defined by:

$$\theta 2=(360^\circ/Zm)\times n2$$

wherein Zm is a number of teeth on said source gear and n2 is a natural number.

38. A method of fabricating an image forming apparatus comprising:

disposing image bearing means along a conveying direction of recording sheet; and positioning drive power transmission means intermediate of said image bearing means and drive source means, said drive power transmission means being configured to translate movement of said drive source means to movement of said image bearing means, said drive power transmission means being divided into groups, wherein said groups are arranged in an alternating relationship and are offset relative to each other and said drive source means so as to provide synchronized movement of said image bearing means, wherein said image bearing means comprises a plurality of image bearing members, said source means comprises a source gear, and said drive power transmission means is positioned such that a plurality of drive gears and a plurality of intermediate gears included in said drive power transmission means form offsetting groups, wherein a predefined number of said plurality of drive gears and at least one of said intermediate gears are included in each of said groups, and wherein a relationship between drive gears in each group and one of said intermediate gears is defined by a first predefined angle, and wherein a relationship between said intermediate gears and said source gear is defined by a second predefined angle.

* * * * *